US007520257B2

(12) United States Patent
Adams et al.

(10) Patent No.: US 7,520,257 B2
(45) Date of Patent: Apr. 21, 2009

(54) ENGINE CYLINDER HEAD

(75) Inventors: Todd M. Adams, Lafayette, IN (US); Scott Beatty, Chicago, IL (US); James William Brogdon, Daphne, AL (US); Michael P. Harmon, Dunlap, IL (US); Humphrey Niven, Worthing (GB); James D. Peltier, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 192 days.

(21) Appl. No.: 11/403,715

(22) Filed: Apr. 13, 2006

(65) Prior Publication Data

US 2007/0240670 A1 Oct. 18, 2007

(51) Int. Cl.
*F02B 23/10* (2006.01)

(52) U.S. Cl. ..... 123/193.5

(58) Field of Classification Search ... 123/193.1–193.5, 123/41.72, 41.75

See application file for complete search history.

(56) References Cited

U.S. PATENT DOCUMENTS

| | | | | | |
|---|---|---|---|---|---|
| 3,882,842 | A * | 5/1975 | Bailey et al. | ..... | 123/193.2 |
| 4,690,104 | A | 9/1987 | Yasukawa | | |
| 4,763,619 | A * | 8/1988 | Eitel | ..... | 123/193.3 |
| 5,207,210 | A * | 5/1993 | Yamagata et al. | ..... | 123/661 |
| 5,575,251 | A * | 11/1996 | Bock | ..... | 123/193.3 |
| 5,970,941 | A * | 10/1999 | Bock | ..... | 123/193.3 |
| 6,116,198 | A * | 9/2000 | Kirtley et al. | ..... | 123/41.84 |
| 6,164,260 | A * | 12/2000 | Bock | ..... | 123/193.2 |
| 6,205,974 | B1 * | 3/2001 | Yonezawa et al. | ..... | 123/305 |
| 6,234,134 | B1 * | 5/2001 | Bedapudi et al. | ..... | 123/193.3 |
| 6,295,955 | B1 | 10/2001 | Kato et al. | | |
| 6,705,269 | B2 * | 3/2004 | Fukuzawa et al. | ..... | 123/193.5 |
| 6,732,698 | B1 * | 5/2004 | Bedwell et al. | ..... | 123/193.2 |
| 6,925,981 | B2 * | 8/2005 | Ibukuro et al. | ..... | 123/193.2 |

FOREIGN PATENT DOCUMENTS

| | | |
|---|---|---|
| EP | 0 550 422 A2 | 7/1993 |
| JP | 58-143149 | 8/1983 |
| JP | 62-142850 | 6/1987 |
| JP | 10-220286 | 8/1998 |
| WO | WO 2005/042955 A2 | 5/2005 |

OTHER PUBLICATIONS

PCT International Search Report; PCT/US2007/006839; International Filing Date: Mar. 20, 2007; Applicant's File Ref.: 05-754; Applicant: Caterpillar Inc.

* cited by examiner

*Primary Examiner*—M. McMahon
(74) *Attorney, Agent, or Firm*—Finnegan, Henderson, Farabow, Garrett & Dunner

(57) ABSTRACT

A cylinder head of an engine is disclosed, the cylinder head including an upper deck, a lower deck, and a sidewall extending between the upper deck and the lower deck. The lower deck defines a block-engaging portion and a combustion chamber flame deck. The combustion chamber flame deck is spaced apart from the block-engaging portion. An engine is also disclosed that includes a cylinder block having a cylinder bore, and a piston slidably positioned within the cylinder bore. The engine also includes a cylinder head having a lower deck connected to the cylinder block, the lower deck defining a block-engaging portion and a combustion chamber flame deck. The combustion chamber flame deck is spaced apart from the block-engaging portion by a recess.

19 Claims, 6 Drawing Sheets

ENGINE CYLINDER HEAD

TECHNICAL FIELD

The present disclosure relates generally to a cylinder head for use with an internal combustion engine, and more particularly to a cylinder head having a recess separating a combustion chamber flame deck from a cylinder block-engaging portion.

BACKGROUND

A typical internal combustion engine includes a cylinder block, a cylinder head attached to the block, one or more pistons, and one or more combustion chambers. The cylinder block has at least one cylinder bore containing a cylinder liner, and each piston is slidably positioned within each cylinder liner. The cylinder head has a body, and the body, the piston, and the cylinder liner define the combustion chamber.

A typical cylinder head for an internal combustion engine is formed by a casting process and has an inner wall, an outer wall, and sidewalls. The cylinder head is designed to control gaseous flow from intake manifolds in the cylinder head to the combustion chamber and from the combustion chamber to exhaust manifolds in the cylinder head. The cylinder head may have three regions, commonly referred to as an upper deck, a middle deck, and a lower deck. The lower deck is mounted to the cylinder block adjacent to, and partially defining, one or more of the combustion chambers. Generally, the gaseous flow passes through the lower deck of the cylinder head. If required, the cylinder head may support a fuel injector and a firing mechanism for each combustion chamber of the internal combustion engine. Because each of these requires openings to the combustion chamber through the lower deck, there are areas on the lower deck subject to increased levels of heat and stress that develop during the combustion process.

As a result of the operation of the internal combustion engine, the combustion chamber, cylinder head, and piston, as well as other areas of the cylinder block are exposed to high levels of heat. The heat creates thermal gradients through the engine that result from heat of the combustion process and a cooling system process. The thermal gradients can create localized stress regions and hot spots within the lower deck of the cylinder head that have the potential to alter the alignment of the valves, the fuel injector, the firing mechanism, and other components in the engine, which can cause the engine to operate in a less than ideal manner. In addition, with the lower deck of the cylinder head experiencing these stresses, the lower deck has the potential to deform or crack.

Generally, fluid flow paths have been provided in the cylinder head to draw heat from the hot spots. The use of the flow paths as cooling fluid passageways assists in maintaining the cylinder head near a uniform temperature and reduces the likelihood of fracturing as the cylinder head temperature fluctuates. U.S. Pat. No. 4,690,104 ("Yasukawa") describes one such type of cylinder head. Yasukawa is directed to a cylinder head that provides plugs to speed up coolant flow in regions of large cross-sectional areas. In addition, Yasukawa provides several fins located on boss portions for securing the cylinder head to the cylinder block, as well as on cylindrical walls that connect the intake and exhaust valves to the combustion chamber.

One drawback to Yasukawa is that neither the plugs nor the fins provide additional rigidity to the inner walls of the cylinder head. As a result, the inner walls have the potential to experience problems with a lack of stiffness and failure because of the cyclic loadings created by combustion of fuel in the combustion chambers. Additionally, Yasukawa does not provide cooling fluid flow in certain areas of the engine that are likely to have the highest temperatures.

The present disclosure is directed to overcoming one or more of the problems or disadvantages existing in the prior art.

SUMMARY OF THE INVENTION

In one aspect, a cylinder head is provided. The cylinder head includes an upper deck, a lower deck, and a sidewall. The sidewall extends between the upper deck and the lower deck. The lower deck of the cylinder head defines a block-engaging portion and a combustion chamber flame deck. The combustion chamber flame deck is spaced apart from the block-engaging portion of the lower deck.

In another aspect, an engine is provided. The engine includes a cylinder block having a cylinder bore, and a piston slidably positioned within the cylinder bore. A cylinder head is also provided and has a lower deck connected to the cylinder block. The lower deck defines a block-engaging portion and a combustion chamber flame deck. The combustion chamber flame deck is spaced apart from the block-engaging portion by a recess.

DETAILED DESCRIPTION

Figure 1:
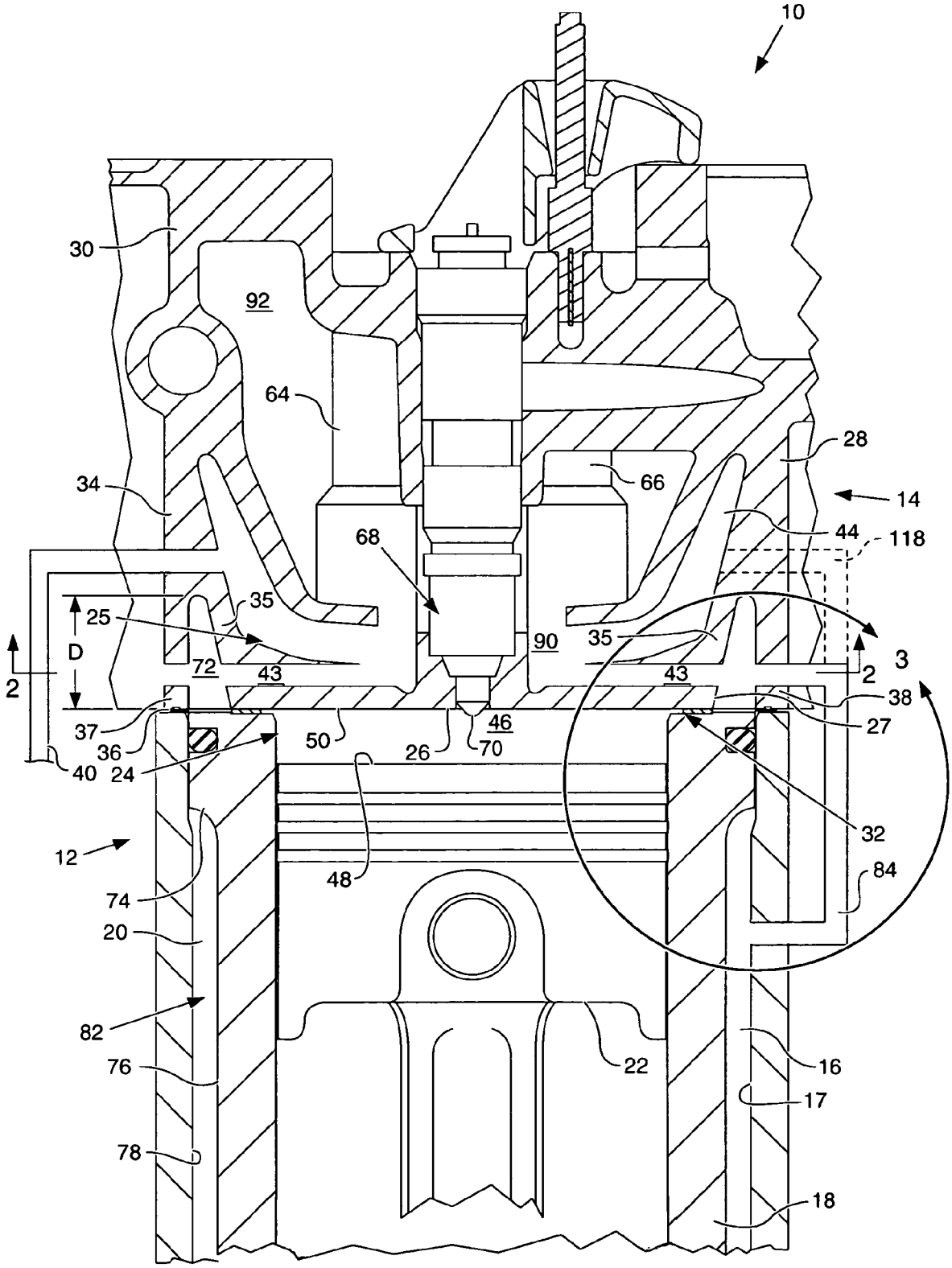
FIG. 1 is a sectional view of a portion of an engine having a cylinder block and a cylinder head.

Referring now to the drawings, there is illustrated in FIG. 1, a portion of an internal combustion engine 10. The engine 10 includes a cylinder block 12 and a cylinder head 14 attached to the block 12. The cylinder head 14 and the cylinder block 12 can be connected using any suitable mechanism, as would be understood by one skilled in the art. The cylinder block 12 defines a cylinder bore 16, in which a cylinder liner 18 is disposed. A space exists between an inner wall 78 of the cylinder bore 16 and the cylinder liner 18. This space defines a cylinder fluid jacket 20 as will be described in greater detail below. A piston 22 is slidably positioned within the cylinder liner 18. The piston 22 travels within the cylinder liner 18 between a top dead center position (TDC), i.e. the position closest to the cylinder head 14, and a bottom dead center position (BDC), i.e. the position furthest from the cylinder head 14. The piston 22, the cylinder liner 18, and cylinder head 14 define a combustion chamber 24. The portion of the cylinder head 14 that defines the upper part of the combustion chamber 24 is a combustion chamber flame deck 26. In the engine 10 illustrated in FIG. 1, only one vertically oriented cylinder bore 16 and one piston 22 is shown within the cylinder block 12. However, the cylinder block 12 may be of any other conventional design, such as "V" or radial, and may have any number of bores 16 and pistons 22, equally or unequally spaced, in the cylinder block 12.

The cylinder head 14 of the engine 10 includes a body 28. The body 28 is defined by an upper deck 30, a lower deck 32, and a sidewall 34 extending between the upper deck 30 and the lower deck 32. A portion of the lower deck 32 is in direct engagement with the cylinder block 12 and is referred to herein as the cylinder block-engaging portion 36. The block-engaging portion 36 is a generally planar surface as can be seen more clearly in FIG. 2. It should be appreciated that although the lower deck 32 includes a portion described as being the block-engaging portion 36, the cylinder head could engage a cooling water collar or other structure. Thus, although the lower surface of the cylinder head 14 does not directly engage the cylinder block 12, the cylinder head 14 is at least indirectly or partially supported thereon.

Figure 2:
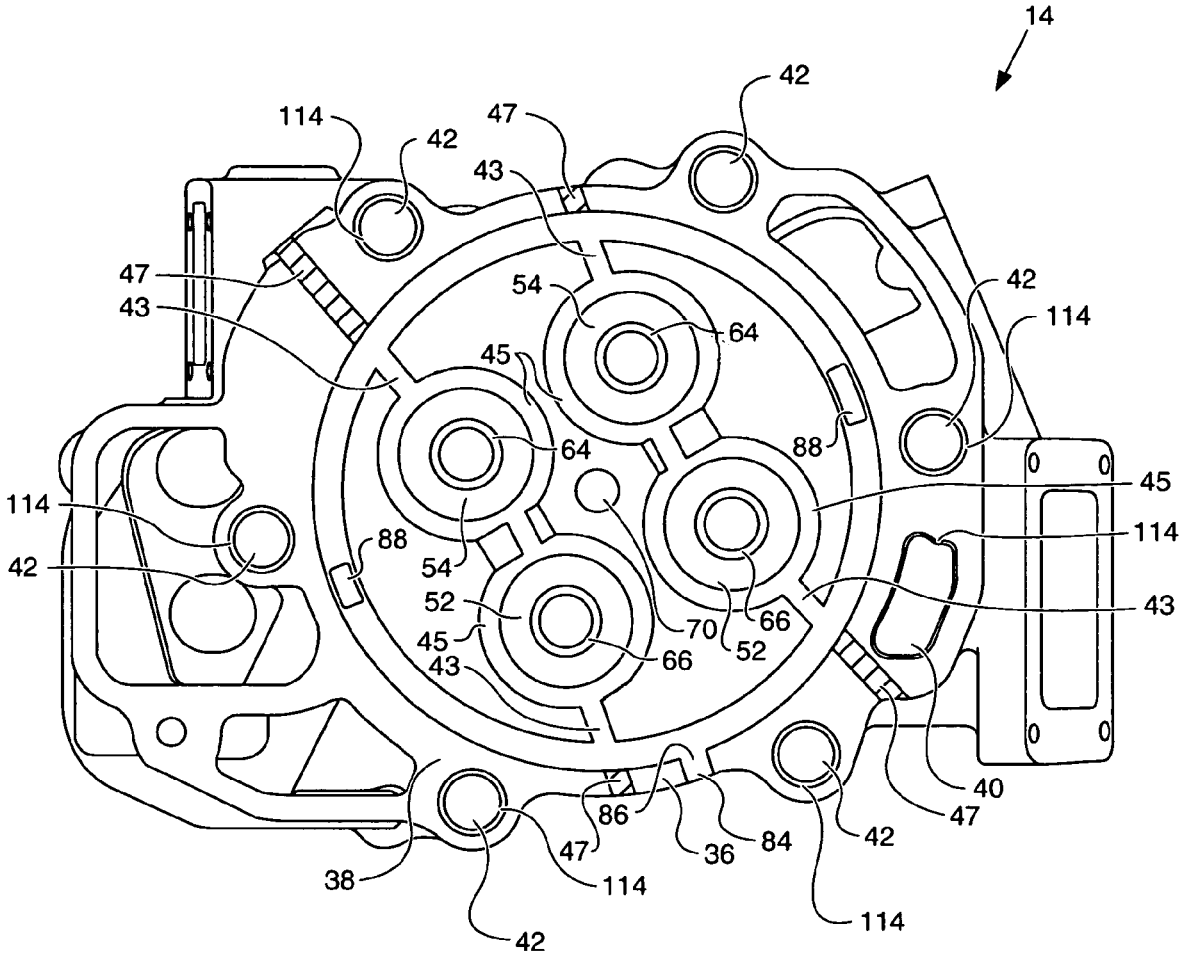
FIG. 2 is a sectional view of the cylinder head of FIG. 1 through Line 2-2.

FIG. 2 is a sectional view of the cylinder head 14 and illustrates a portion of the block-engaging portion 36 and a recess 72. As illustrated in FIGS. 1 and 2, the combustion chamber flame deck 26 and the block-engaging portion 36 of the lower deck 32 are spaced apart from each other. As shown, the block-engaging portion 36 is circumferentially offset from the combustion chamber flame deck 26. The recess 72 separates the combustion chamber flame deck 26 and the block-engaging portion 36. The block-engaging portion 36 can also include a plurality of openings 42 formed therein. The openings 42 in the block-engaging portion 36 can serve a number of purposes. Primarily, the openings 42 are fastener openings 42 that can serve as passageways through which fasteners (not shown) can be passed in order to attach the cylinder head 14 to the cylinder block 12. Still other openings (not shown) can be formed to reduce the overall weight of the cylinder head 14.

Also shown in FIGS. 1 and 2 are multiple flow paths and channels formed in the cylinder head 14. Extending into the cylinder head 14 from a source, such as a fluid reservoir (not shown), is a cooling fluid line 40. The cooling fluid line 40 acts as a supply line between the reservoir and a cylinder head fluid jacket 44. As shown, the cooling fluid line 40 bypasses, and does not supply fluid to, the cylinder fluid jacket 20. The reservoir also supplies fluid to the cylinder fluid jacket 20 to provide cooling around the piston 22. A first fluid conduit 84 is shown as connecting the cylinder fluid jacket 20 to the recess 72 to supply fluid to the recess 72. Shown in dashed lines is a second fluid conduit 118. The second fluid conduit 118 (further shown and described in FIG. 4) connects the cylinder fluid jacket 20 to the cylinder head fluid jacket 44. Although these fluid conduits appear to be external conduits, it can be appreciated that the representations herein are schematic only, and the fluid conduits can be constructed internally or internally, or a combination of both internal and external fluid conduits.

Figure 3:
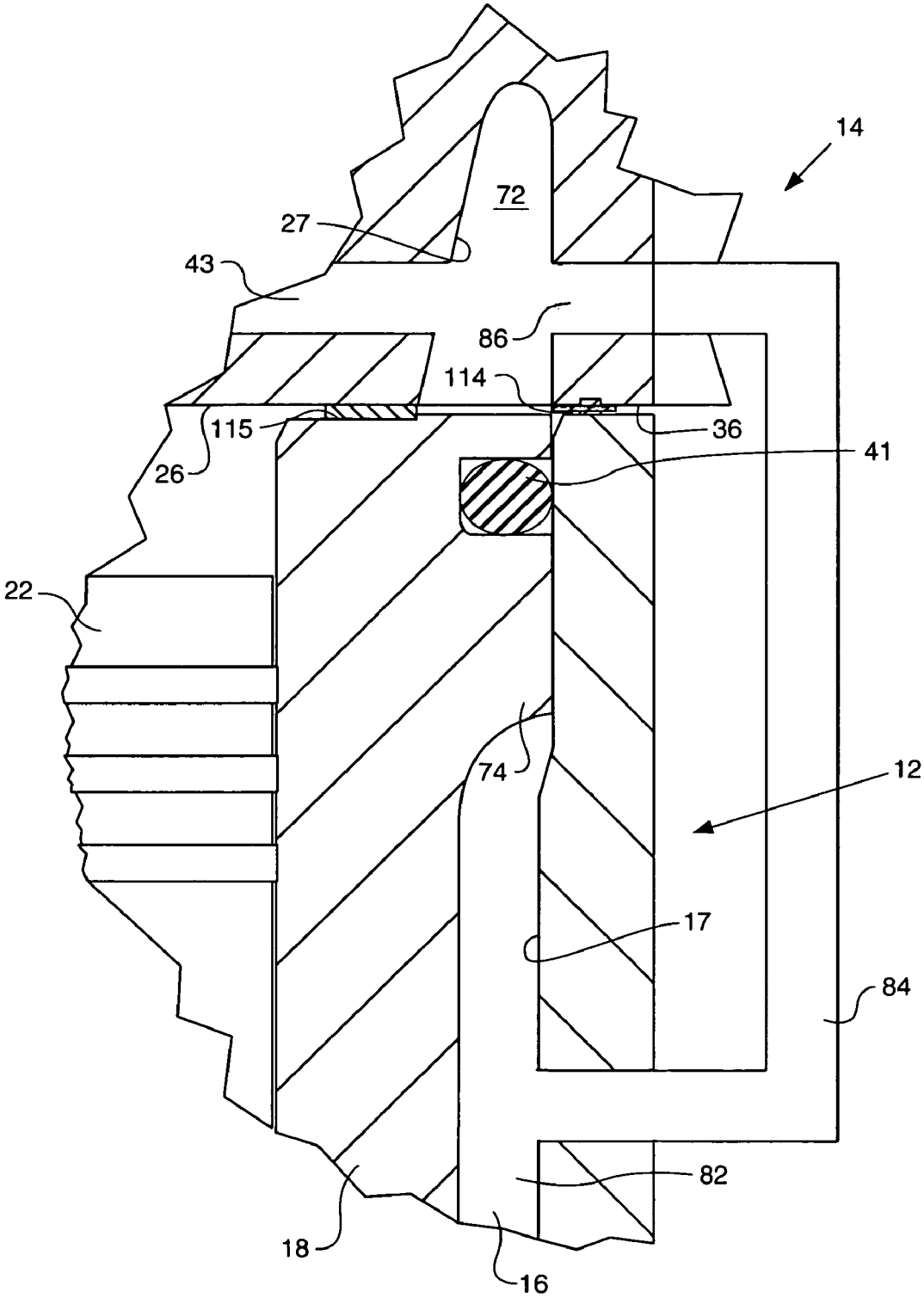
FIG. 3 is an enlarged view of a portion of the engine shown in FIG. 1

Also shown in FIGS. 1 and 3 are a plurality of drillings 43. The drillings 43 (the use of which is generally known in the art) are passageways formed by drilling into the cylinder head 14. The drillings 43, in the illustrated embodiment, intersect the recess 72, thereby defining exit ports 88 from the recess 72, and extend into fluid communication with a lower portion 90 of the cylinder head fluid jacket 44. The drillings can also be in fluid communication with channels 45 that encircle each (or selected ones) of the first and second orifices 52, 54. To seal the outermost portions of the drillings 43 so that the cooling fluids do not spill out of the cylinder head 14, plugs 47 are used to block the outermost ends of the drillings 43. It should be appreciated that the fluid could be water, oil, air, or any other fluid that is suitable for providing cooling according to the invention. It can be appreciated that the drillings 43 would preferably be formed inside the cylinder head 14 and would not be visible when viewing the lower deck 32 of the cylinder head 14.

As stated above, the portion of the lower deck 32 that is located above the cylinder bore 16, and defines an upper portion of the combustion chamber 24, is the combustion chamber flame deck 26. Formed within the combustion chamber flame deck 26 is a plurality of orifices, indicated generally at 50. Illustrated in FIG. 1 (and more clearly in FIG. 2) are the first orifice 52 and the second orifice 54. The first orifice 52 and the second orifice 54 can also be referred to as valve seats. The first orifice 52 and the second orifice 54 provide passageways between an intake port and an exhaust port (not shown), respectively, into the combustion chamber 24 when the ports are in open positions, that is, when a respective intake valve 60 or exhaust valve 62 is unseated. The inner circles refer generally to valve guide bores 64, 66 that would support the stems of the valves located at those positions. Such guides are generally known in the art.

An intake valve 60 and an exhaust valve 62 is disposed within a separate intake valve chamber 64 and an exhaust valve chamber 66 formed in the body 28 of the cylinder head 14, as shown in FIG. 1. Operation of the valves 60, 62 in a reciprocating manner causes the orifices 52 and 54 to alternatingly open and close, thereby allowing air to flow through the orifices 52 and 54 and into, or out of, the combustion chamber 24. Although only one intake valve 60 and one exhaust valve 62 is shown due to FIG. 1 being a sectional view, it can be seen in FIG. 2 that the engine 10 includes two intake valves 60 and two exhaust valves 62 (with a corresponding pair of first orifices 52 and second orifices 54). It should also be appreciated that the engine 10 can include any number of valves 60, 62 and orifices 52, 54.

A fuel injector 68 is also positioned within the body 28 of the cylinder head 14. A fuel injector opening 70 in the combustion chamber flame deck 26 allows fuel to be passed into the combustion chamber 24 via the injector 68. As shown, the fuel injector 68 is centrally positioned within the combustion chamber flame deck 26. The detailed operation of the intake valves 60, exhaust valves 62 and fuel injector 68, in accordance with the operation of the engine 10, is generally known in the art and will not be described in further detail. As is also known, the operation of the engine 10 causes combustion within the combustion chamber 24. This in turn causes the generation of heat and pressure, which can result in stresses acting upon the lower deck 32 of the cylinder head 14. It should be appreciated that the invention could be configured to work with a spark-ignited engine by including a spark plug orifice and spark plug in the combustion chamber flame deck and cylinder head, respectively.

Also shown in FIG. 1, and partly in FIG. 3, is the interconnection between the upper deck 30, lower deck 32 and sidewall 34 of the cylinder head 14. As stated above, an outer portion of the lower deck 32 defines the block-engaging portion 36. A lower end 38 of the sidewall 34 defines the block-engaging portion 36. Also shown in FIG. 1 is the combustion chamber flame deck 26. Since the recess 72 separates the combustion chamber flame deck 26 from the block-engaging portion 36, the outer periphery 27 of the combustion chamber flame deck 26 is not directly supported by the sidewall 34 at the lower end 38 of the sidewall 34. An inner support wall 35 extends from the outer periphery 27 of the combustion chamber flame deck 26 and connects the flame deck 26 to the sidewall 34. In the illustrated embodiment, the combustion chamber flame deck 26 is supported on the sidewall 34 at a position above the lower end 38 of the sidewall 34 and not at the lower end 38 of the sidewall 34.

Figure 5:
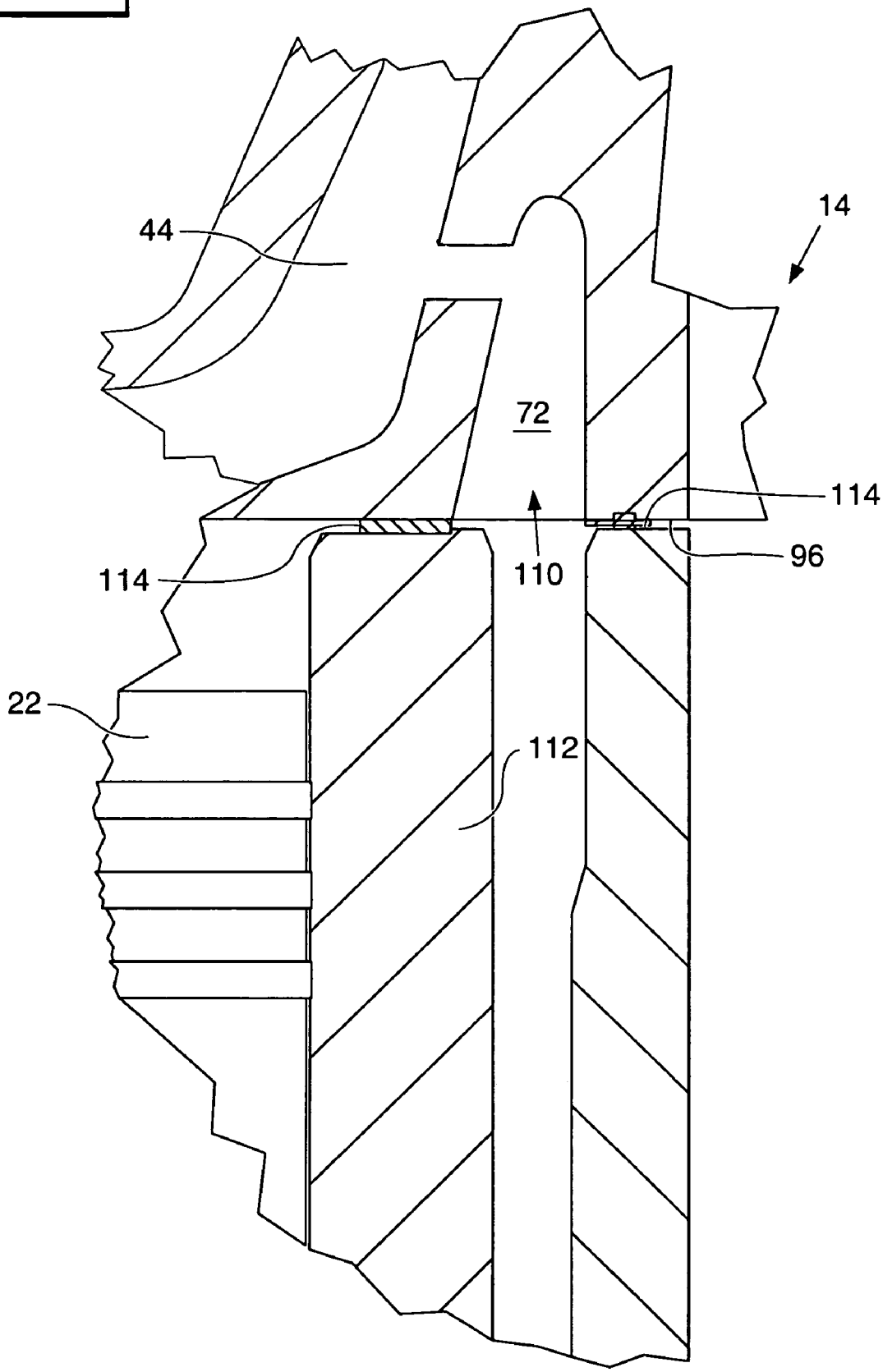
FIG. 5 is an enlarged view of a portion of an engine, similar to that shown in FIG. 3, having an alternate embodiment of a cylinder liner.

Illustrated in FIG. 3, there is an enlarged sectional view of a portion of the engine 10 showing the arrangement between the cylinder head 14, particularly the recess 72, and the cylinder block 12 in greater detail. The recess 72 defines an outer periphery 27 of the combustion chamber flame deck 26. As shown in FIG. 2, the recess 72 encircles the combustion chamber flame deck 26, and therefore, borders the first valve orifice 52 and second valve orifice 54 and the fuel injector opening 70. The size of the recess 72 (the outer diameter of the recess 72 in the illustrated embodiments) is such that the recess 72 encircles the combustion chamber flame deck 26 and is at least partially aligned with the cylinder bore 16. In this manner, when the cylinder head 14 and the cylinder block 12 are assembled, a portion of the cylinder bore 16 could be open to the recess 72. Such a configuration is illustrated in FIG. 5. However, as shown in FIGS. 1 and 3, a spacer 74 separates the cylinder bore 16 from the recess 72.

It can be appreciated that the recess 72 can have any size, shape, width, and height. As shown, the recess 72 has a generally triangular cross-sectional shape. However, it should be appreciated that the recess 72 could have a half-oval, semi-circular, or rectangular shape as well. The recess 72 has a depth, D, into the lower deck 32 of the cylinder head 14 thereby providing a separation between the remaining portion of the lower deck 32 and the combustion chamber flame deck 26. The extent to which the recess 72 extends into the body 28 of the cylinder head 14 can depend on several design criteria including structural requirements of the cylinder head 14 or the engine 10, the amount of heat and pressure the cylinder head 14 will be subjected to, the size and performance requirements of the engine 10, and the location and size of fluid jackets within the cylinder head 14. One skilled in the art can appreciate that many other design factors can be considered when determining the exact size and shape of the recess 72.

In FIG. 3 the spacer 74 extending from the outer surface 76 of the cylinder liner 18 to the inner wall 17 of the cylinder bore 16 defines the upper portion of the fluid jacket 20 around the cylinder liner 18. In this embodiment, fluid is permitted to flow within the lower portion 82 of the fluid jacket 20. The spacer 74 would seal the upper portion from the rest of the fluid jacket 20. A seal 41 could be located at the outer edge of the spacer 74 to prevent fluid flow past the spacer 74. Fluid is supplied to the lower portion 82 of the fluid jacket 20 from a source (not shown), and then passes from the fluid jacket 20 via a first fluid conduit 84 through the cylinder block 12, through the cylinder head 14 and into the recess 72 via a fluid inlet port 86.

Referring again to FIG. 2, the fluid would then flow around the recess 72 and out of the recess 72 through the drillings 43. Since the drillings 43 intersect with the cylinder head fluid jacket 44, the fluid jacket 44 would receive the fluid after it passes through the recess 72. Therefore, the recess 72 acts as a cooling jacket around the combustion chamber flame deck 26. Also, fluid passes around the recess 72, and then flows through the drillings 43 to act as a lower fluid jacket for the cylinder head. As was described above, channels 45 could also be formed around the orifices 52 and 54 thereby providing a flow path for the fluid around the orifices 52 and 54 to cool those surfaces as well. It should be appreciated that any number of inlet ports 86 can be formed to supply fluid to the recess 72. Additionally, any number of drillings 43 can be used to interconnect the recess 72 to the fluid jacket 44, and to cool the combustion chamber flame deck 26.

Alternatively, or additionally, fluid could flow out of the recess via a fluid exit port 88 (shown schematically in FIG. 2). As shown, a pair of exit ports 88 is formed in the recess 72 with each port 88 being spaced approximately 180 degrees apart. It should be appreciated that any number of inlet ports 86 and exit ports 88 can be formed in the recess 72 and that the inlet and exit ports 86, 88 can have any spacing about the recess 72. However, additional chambers, recesses and seals would be necessary to prevent fluid flow into the combustion chamber 24. The exit ports 88 would be in fluid communication with the cylinder head fluid jacket 44 in any suitable manner.

When the fluid exits the recess 72, the fluid flows into the cylinder head fluid jacket 44 formed in the body 28 of the cylinder 14. The body 28 of the cylinder head 14 can define one or more fluid jackets. In the illustrated embodiment, the cylinder head fluid jacket 44 defines a lower portion 90 and an upper portion 92. The lower portion 90 surrounds the valve chambers 64, 66 and allows a coolant fluid to pass through the lower portion 90 in order to remove heat from an upper portion 25 of the combustion chamber flame deck 26, the first and second orifices 52, 54, and the exterior surfaces of the fuel injector 68. Fluid then flows into the upper portion 92 of the fluid jacket 44, further cooling the exhaust ports and intake ports of the cylinder head 14 and then out of the cylinder head 14, eventually before continuing on to a heat exchanger (not shown). It should be appreciated that the fluid can be directed to flow into any portion of the fluid jacket 44 in any order. Using the cooling fluid line 40 and the first fluid conduit 84 can allow for accurate control of the amounts of fluid being supplied to each area of the cylinder head 14 to facilitate cooling. For example, sixty-five percent (65%) of the fluid flow could be through the cooling fluid line 40 so that the majority of the fluid reaches the cylinder head fluid jacket 44. The remaining fluid, thirty-five percent (35%), could be directed into the cylinder fluid jacket and then into the recess 72, and eventually into the lower portion 90 of the cylinder head fluid jacket 44. It should be appreciated that these amounts are exemplary only, and that any amount of fluid flow can be directed through the various fluid passageways.

It should be appreciated that seals 114 and other mechanisms can be used to prevent the fluids from passing into the combustion chamber 24 and into the various openings 42, 52, 54, and 70 on the block-engaging portion 36 and in the combustion chamber flame deck 26. The exact materials, structure, shape, and location of such sealing mechanisms are not described in detail as they are generally known in the art, or their use would be evident to one skilled in the art.

INDUSTRIAL APPLICABILITY

In the operation of an engine 10, high levels of heat are generated within the combustion chamber 24. The heat is transferred throughout the engine 10 and its components. As is known in the art, fluids are used as coolants to transfer heat from these surfaces. Various chambers and fluid jackets are included in engines to contain and carry the cooling fluids within and around the engine 10. According to the present invention, fluid flow to and within the recess 72 also acts to cool portions of an engine 10 that are not typically cooled.

As is also known, due to the high heat and pressures, a large amount of stress is placed on the combustion chamber flame deck 26. To provide increased structural support, the recess 72 separates the combustion chamber flame deck 26 from the rest of the lower surface of the cylinder head 14. This allows the inner support wall 35 to directly connect the outer periphery 27 of the combustion chamber flame deck 26 to the sidewall 34. By providing direct support at a region of the cylinder head 14 that is subject to high stress (bending stress, as well as other mechanical stresses) the structural integrity of the cylinder head 14 is increased. Since the recess acts as a break between the combustion chamber flame deck 26 and the lower end 38 of the sidewall 34, the inner support wall 35 is angled relative to the plane of the lower deck 30 of the cylinder head 14. Therefore, the inner support wall 35 is supported on the sidewall 34 at a point above the lower end 38 of the sidewall 34. Such a structure is a result of the lower deck 32 of the cylinder head 14 being separated into distinct portions by the recess 72. Although the inner support wall 35 is being described as a connector between the combustion chamber flame deck 26 and the cylinder head body 28, it should be appreciated that the cylinder head 14 is typically cast as a unitary structure and that there is no separate connection required between the inner support wall 35 and the sidewall 34. However, it should also be appreciated that any suitable process can be used to create the inner support wall 35 and connect it between the outer periphery 27 of the combustion chamber flame deck 26 and the sidewall 34. This structure is common to each of the embodiments described herein. It should also be appreciated that that inner support wall 35 could be angled, arced, or be straight (generally vertically oriented in the embodiment shown in the Figs.) and directly connect with the upper deck 30 of the cylinder head 14 if it is so desired. Such configurations all act to directly support the outer periphery 27 of the flame deck 26 with the rest of the cylinder head 14.

It should be appreciated that the implementation of the recess 72 can "short circuit" the conduction of heat along the entire lower deck 32 of the cylinder head 14. In addition to the recess 72 separating the combustion chamber flame deck 26 and the block-engaging portion 36, therefore acting as a mechanical break in the conduction path of heat generated by the engine 10, if fluid is flowing within the recess 72, then the heat is being transported away from the heated surfaces, thereby decreasing the heat conduction from the combustion chamber flame deck 26 to the block-engaging portion 36 of the cylinder head 14. Such a break in the heat conduction path also limits the amount of heat that affects the seals 114 surrounding the combustion chamber flame deck 26 and particularly the outer seals 114 between the cylinder block 12 and the cylinder head 14. Therefore, the integrity of the seals 114 can be improved by the additional dispersal of heat. Since heat is being rejected from the combustion chamber flame deck 26, the first and second orifices 52, 54 can be isolated from some of the heat as well. This has the potential to prevent distortions of the orifices 52, 54 that may be caused by heat and stress within the combustion chamber 24.

The design of the recess 72 also allows for thermal expansion of the combustion chamber flame deck 26. Due to the large amount of heat generated during the operation of an engine 10, the metal components of the engine 10 could expand (in very small amounts). Therefore, the recess 72 gives the combustion chamber flame deck 26 space to expand without affecting the remaining portion of the lower deck 32 of the cylinder head 14. This also reduces the internal stresses in the cylinder head 14 since these areas have the room to expand rather than perpetuating the stress throughout the body 28 of the cylinder head 14. In addition, if any gases from within the combustion chamber 24 were to escape past the seals 114, the recess 72 provides an area in which the gases can expand and cool. Allowing the gases to expand and cool in this manner also helps to prevent the blow out of a seal 114 between the lower end 38 of the sidewall 34 and an upper surface of the cylinder block 12.

It was stated above that the recess 72 could be designed based on many factors. One consideration in the design of the recess 72 is the desired amount of cooling around the combustion chamber flame deck 26. This is because the recess 72 can be used to assist with the heat rejection function of the engine 10 in combination with the various fluid jackets 20, 44 and flow paths described herein and illustrated in the Figures. The recess 72 can be configured to receive a fluid from the fluid jacket 20 of the cylinder block 12. Such fluid communication can be either direct or indirect, as will be explained below.

In the embodiment illustrated in FIGS. 1-3, a fluid is circulated around the exterior of the cylinder liner 18 and flows via the first fluid conduit 84 or other flow path through the inlet port 86. From the inlet port 86, the fluid flows into the recess 72, through the drillings 43, and then into the lower fluid jacket 90 within the body 28 of the cylinder head 14 to cool the exterior surfaces of the valve chambers 64, 66 and also to cool the upper portion 25 of the combustion chamber flame deck 26. The fluid then flows towards the upper portion 92 of the cylinder head fluid jacket 44 and then is carried to a heat exchanger (not shown) where the heat is removed from the fluids before the fluids make a subsequent pass through the circuit described above. The recess 72 is utilized to provide additional cooling to the heated surfaces of the engine 10. In particular, the recess 72 allows fluid to flow directly around the combustion chamber flame deck 26 between the flame deck 26 and the block-engaging portion 36. As described above, in the first embodiment, the fluid conduit 84 establishes a fluid communication between the fluid jacket 20 and the recess 72. The fluid jacket 20 is, therefore, in indirect communication with the recess 72.

It should be appreciated that the use of the drillings 43, the cooling fluid line 40 and the recess 72 to carry a fluid to assist with the cooling of the interior portions of the cylinder head 14, can also be used to control the amount of fluid that is directed to specific locations. For example, if additional cooling is required around the combustion chamber flame deck 26 the flow through the first fluid conduit 84 could be increased while the flow through the cooling fluid line 40 is reduced. Similarly, drillings 43 could be added or removed depending on whether cooling around specific orifices (only intake valve seats or exhaust valve seats) is desired.

Figure 4:
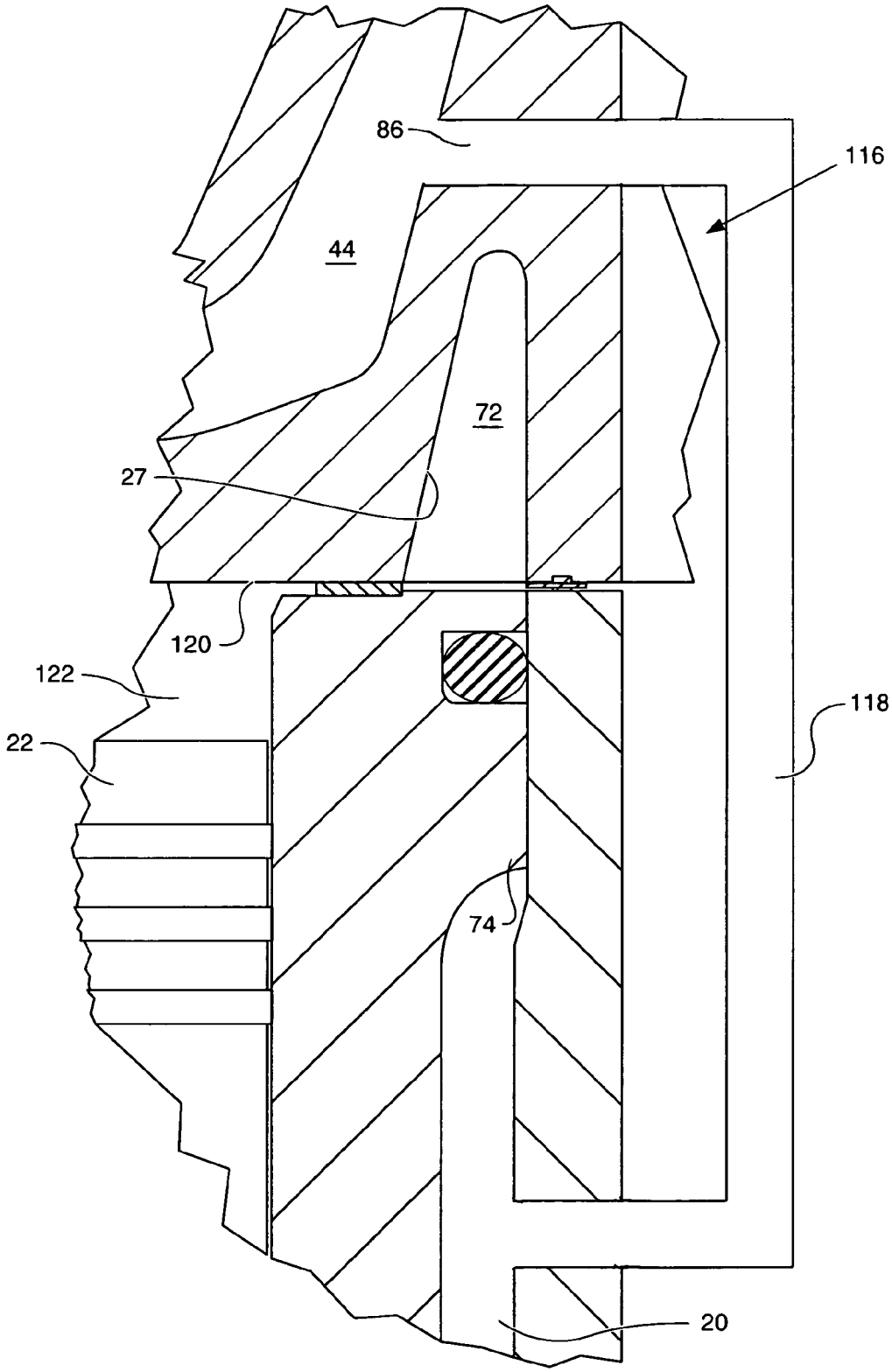
FIG. 4 is an alternate embodiment of a portion of the engine illustrated in FIGS. 3.

Illustrated in FIG. 4 is an alternate embodiment of the invention. In FIG. 4, a cylinder head 116 having substantially the same structure as the cylinder head 14 shown in FIG. 1 is shown. However, in this embodiment, the second fluid conduit 118 extends from the cylinder fluid jacket 20 and into the cylinder head fluid jacket 44. Therefore, there is no fluid flow into the recess 72 in this embodiment. However, including the recess 72 in this embodiment gives the combustion chamber flame deck 120 room to expand and contract due to changes in thermal stress acting on the combustion chamber flame deck 120. Additionally, should any gases that are formed during the combustion process escape from the combustion chamber 122 through the seals 114, the space created by the recess 72 provides an area in which the gases can cool. Such cooling prevents an additional cause of increased pressure acting against the cylinder head 116.

In an alternate embodiment, such as that shown in FIG. 5 an alternate embodiment of a cylinder liner 112 is used with the engine 10 of FIG. 1. The cylinder liner 112 does not include a spacer 74 such as that formed on the cylinder liner 18. Therefore, there is a direct fluid flow path 110 from the cylinder head fluid jacket 44 around the cylinder liner 112 into the recess 72. Therefore, fluid can flow along the majority of the length L of the cylinder liner 112. In addition, since the cylinder fluid jacket 20 is in direct fluid communication with the recess 72, no fluid conduits or fluid inlet ports are required, thereby simplifying and reducing the time and costs associated with manufacturing the engine 10. Also, since there is a direct fluid communication between the cylinder fluid jacket 20 and the recess 72, an upper portion of the cylinder liner 112 is exposed to the fluid. This is a location that is not typically cooled; therefore additional engine 10 cooling can be achieved. Fluid would exit the recess 72 via a connecting channel 111. Thus, the fluid could flow into the cylinder head fluid jacket 44. From there, the fluid flow would be substantially as was described above. It should be appreciated that this configuration can be adapted to operate with the embodiments shown in any of the other FIGS. as well, and can act as a secondary fluid flow path if such a configuration is desired.

Figure 6:
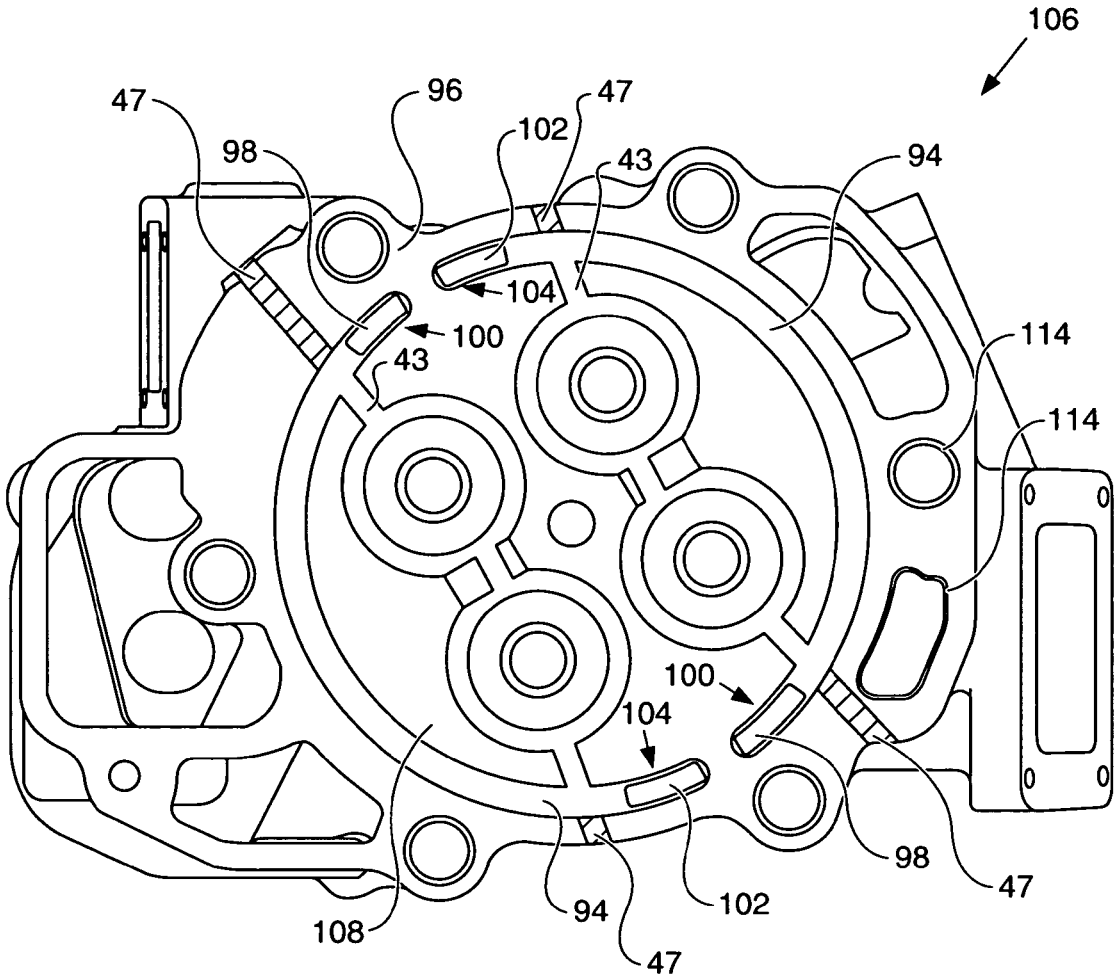
FIG. 6 is a sectional view of a cylinder head according to an alternate embodiment of the invention.

In another alternate embodiment of the cylinder head 106 shown in FIG. 6, a recess, similar to the recess 72 shown in FIGS. 1-3, is formed in the lower deck 96 of the cylinder head 106 as a pair of recesses 94. Each recess 94 is a semi-circle and partially encircles the outer periphery 27 of the combustion chamber flame deck 108. An inlet port 98 is formed at a first end 100 of each recess 94 and an exit port 102 is formed at a second end 104 of each recess 94. Each inlet port 98 and exit port 102 are shown to be at opposite ends of each recess 94. This enables the fluid to flow from each inlet port 98 around the recess 94 and out of the exit port 102 thereby flowing around, and cooling, the outer periphery 27 of the combustion chamber flame deck 26. It should be appreciated that the recess 94 can be further divided, if it so desired, to form multiple recesses, each having an inlet port 98 (connected to a fluid conduit or in direct fluid communication with the cylinder jacket 20 such as that shown in FIG. 5), and an exit port 102 (connected to a fluid jacket or a return line). It should be appreciated that drillings 43 could also be used with this embodiment to connect the recess 72 to a fluid jacket formed in the cylinder head 14.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A cylinder head comprising:

an upper deck;

a lower deck defining a block-engaging portion and a combustion chamber flame deck; and a sidewall extending between the upper deck and the lower deck;

wherein the combustion chamber flame deck is spaced apart from the block-engaging portion by a recess formed in the lower deck of the cyclinder head, wherein the recess defines an outer periphery of the combustion chamber flame deck thereby spacing the combustion chamber flame deck apart from the block-engaging portion, the recess extending around a majority of the outer periphery of the combustion chamber flame deck.

wherein the recess at least partially overlaps, in a vertical direction, a cylinder liner of a cylinder block, and wherein the recess is in fluid communication with a fluid jacket disposed around the cylinder liner.

2. The cylinder head of claim 1 wherein the recess completely encircles the outer periphery of the combustion chamber flame deck.

3. The cylinder head of claim 1 wherein the recess partially encircles the outer periphery of the combustion chamber flame deck.

4. The cylinder head of claim 1 wherein the recess has one of a triangular cross-sectional shape, a half-oval shape, a semi-circular shape, and a rectangular shape.

5. The cylinder head of claim 1 wherein the recess is in indirect fluid communication with the fluid jacket.

6. The cylinder head of claim 1 wherein the recess is in direct fluid communication with the fluid jacket.

7. The cylinder head of claim 6 wherein the recess has an outer periphery that is sized and shaped to at least partially correspond to the size and shape of an outer periphery of the fluid jacket around the cylinder liner.

8. The cylinder head of claim 1 wherein the block-engaging portion is a lower end of the sidewall, and the combustion chamber flame deck is supported on the sidewall at a position above the block-engaging portion.

9. The cylinder head of claim 8 wherein the combustion chamber flame deck is supported on the sidewall by an inner support wall positioned between the combustion chamber flame deck and the sidewall.

10. An engine comprising:

a cylinder block having a cylinder bore, and a piston slidably positioned within the cylinder bore; and a cylinder head having a lower deck connected to the cylinder block, the lower deck defining a block-engaging portion and a combustion chamber flame deck;

wherein the combustion chamber flame deck is spaced apart from the block-engaging portion by a recess extending around substantially an entire of an outer perimeter of the combustion chamber flame deck wherein the recess at least partially overlaps, in a vertical direction, a cylinder liner disposed in the cylinder block, and wherein the recess is in fluid communication with a fluid jacket disposed around the cylinder liner.

11. The engine of claim 10 wherein the fluid jacket is defined by an outer diameter of the cylinder liner and an inner wall of the cylinder bore; and wherein a portion of the recess in the cylinder head is aligned with the fluid jacket thereby defining a direct fluid path between the fluid jacket and the recess.

12. The engine of claim 11 wherein the fluid jacket extends along a majority of the length of the cylinder liner.

13. The engine of claim 10 wherein the fluid jacket is defined by an outer diameter of the cylinder liner and an inner wall of the cylinder bore;

wherein the cylinder liner includes a spacer extending from an outer surface of the cylinder liner to the inner wall of the cylinder bore to provide a cooling channel in the fluid jacket; and wherein the cooling channel is in fluid communication with the recess of the cylinder head via a fluid conduit.

14. The engine of claim 10 wherein the recess includes a pair of exit ports such that a fluid can exit the recess from either of the exit ports.

15. The engine of claim 14 wherein the exit ports are in fluid communication with a second fluid jacket that is formed within the cylinder head.

16. The engine of claim 10 wherein the cylinder head comprises a body defined by an upper deck, the lower deck, and a sidewall extending between the upper deck and the lower deck;

wherein the block-engaging portion is a lower end of the sidewall, and the combustion chamber flame deck is supported on the sidewall at a position above the block-engaging portion; and the combustion chamber flame deck is supported on the sidewall by an inner support wall that is positioned between the combustion chamber flame deck and the sidewall.

17. The engine of claim 16 wherein the inner support wall is angled relative to the plane of the lower deck of the cylinder head.

18. A cylinder head comprising:

an upper deck;

a lower deck defining a block-engaging portion and a combustion chamber flame deck; and a sidewall extending between the upper deck and the lower deck;

wherein the combustion chamber flame deck is spaced apart from the block-engaging portion by a recess extending around substantially an entirely of an outer perimeter of the combustion chamber flame deck;

the block-engaging portion is a lower end of the sidewall, and the combustion chamber flame deck is supported on the sidewall at a position above the block-engaging portion by an inner support wall positioned between the combustion chamber flame deck and the sidewall;

the recess at least partially overlaps, in a vertical direction, a cylinder liner of a cylinder block; and the recess is in fluid communication with a fluid jacket disposed around the cylinder liner.

19. The cylinder head defined in claim 18 wherein the inner support wall extends from an outer periphery of the combustion chamber flame deck to the sidewall of the cylinder head.

* * * * *